US008355643B2

(12) United States Patent
Kojima et al.

(10) Patent No.: US 8,355,643 B2
(45) Date of Patent: Jan. 15, 2013

(54) TONER IMAGE HEIGHT MEASUREMENT APPARATUS AND IMAGE FORMING APPARATUS HAVING THE SAME

(75) Inventors: Takehiro Kojima, Cambridge (GB); Takahito Fuse, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 325 days.

(21) Appl. No.: 12/791,373

(22) Filed: Jun. 1, 2010

(65) Prior Publication Data

US 2010/0322648 A1 Dec. 23, 2010

(30) Foreign Application Priority Data

Jun. 19, 2009 (JP) ..... 2009-146473

(51) Int. Cl.
*G03G 15/00* (2006.01)

(52) U.S. Cl. ..... 399/49; 399/40; 399/48; 399/231

(58) Field of Classification Search ..... 399/40, 399/49, 48, 231
See application file for complete search history.

(56) References Cited

U.S. PATENT DOCUMENTS

| | | | | |
|---|---|---|---|---|
| 7,260,334 | B2 * | 8/2007 | Winter et al. | 399/49 |
| 2010/0021196 | A1 * | 1/2010 | Atsumi et al. | 399/74 |

FOREIGN PATENT DOCUMENTS

| | | | |
|---|---|---|---|
| JP | 4-156479 | | 5/1992 |
| JP | 8-327331 | | 12/1996 |
| JP | 2001022139 | * | 1/2001 |
| JP | 2007-199591 | | 8/2007 |

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

A toner image height measurement apparatus capable of accurately measuring heights of toner images of respective colors with a relatively simple construction and without being affected by toner colors. With motion of an image carrier, there occurs a change in reflection light amount detected by a photodiode of the height measurement apparatus in timing when laser light having been irradiated onto the image carrier starts to be irradiated onto or intercepted by a toner image and in timing when the laser light having been irradiated onto the toner image starts to be irradiated onto the image carrier. Based on a principle that these timings vary according to a toner image height, the height measurement apparatus detects the timing when the reflection light amount changes by a predetermined amount, thereby detecting the toner image height.

15 Claims, 12 Drawing Sheets

TONER IMAGE HEIGHT MEASUREMENT APPARATUS AND IMAGE FORMING APPARATUS HAVING THE SAME

BACKGROUND OF THE INVENTION

1. Field of the Invention

The present invention relates to a toner image height measurement apparatus for measuring the height of a toner image carried on an image carrier, and relates to an image forming apparatus, such as a copying machine, a laser printer, or a facsimile machine, mounted with the toner image height measurement apparatus.

2. Description of the Related Art

Conventionally, there are mainly the following two types of electrophotographic full-color image forming apparatuses. The first one is called a four-cycle type in which an imaging apparatus having one photosensitive member is provided and toner images of plural colors are sequentially formed on the photosensitive member by an electrophotographic process according to image information and then transferred onto a transfer member so as to be superimposed one upon another, while rotating the transfer member which is in contact with the photosensitive member. Another one is called a tandem type in which imaging apparatuses each having one photosensitive member are provided and toner images of plural colors are formed on respective ones of the photosensitive members of the imaging apparatuses by an electrophotographic process according to image information and then sequentially transferred onto a transfer member so as to be superimposed one upon another, while rotating the transfer member which is in sequential contact with the photosensitive members. In most of these types of image forming apparatuses, an intermediate transfer member has recently been used in the transfer of toner images onto the transfer member.

With the above image forming apparatus, even if an image is formed under the same setting condition, the density of the formed image varies due to variations in image forming parameters such as toner charge amount, sensitivity of photosensitive member, and transfer efficiency and due to variations in environmental conditions such as temperature and humidity.

Conventionally, therefore, the density or the height of a toner image developed on the photosensitive member or on the intermediate transfer member is detected, and based on a detection result, toner replenishment and/or image forming parameters such as charge potential, image exposure light amount, and developing bias are controlled.

A technique for detecting the toner image density or the toner image height is disclosed in, e.g., Japanese Laid-open Patent Publication Nos. 4-156479, 8-327331, and 2007-199591. In the following, this technique will be described in brief with reference to FIGS. 14 and 15.

FIG. 14 schematically illustrates the toner thickness detection method.

First, a toner patch (toner image) 105 is formed on an image carrier 106 such as a photosensitive member or an intermediate transfer member. Then, light from a light source 101 such as a laser diode is collected on a surface of the toner patch 105 by alight collecting lens 102. Light reflected from the toner patch 105 is received by a light receiving lens 103 and formed into an image on a line sensor 104 that picks up a spatial intensity distribution (light intensity distribution) of the formed image.

Although not illustrated in FIG. 14, the image picked up by the line sensor 104 (i.e., a reflection waveform obtained from the toner patch 105) is converted into a digital signal, to thereby obtain reflection waveform data which is then stored in a memory and from which an amount of toner adhesion is determined by a signal processing unit. In the following, a method for determining the amount of toner adhesion is described.

FIG. 15 illustrates reflection waveforms obtained by the line sensor 104.

As shown in FIG. 15, reflection waveforms each having a peak near the center position on the line sensor 104 can be obtained by the line sensor 104. Since a light path length from the light source 101 to an upper surface of the toner patch 105 differs from a light path length from the light source 101 to an upper surface of the image carrier 106, a position on the line sensor 104 where an image of reflection light from the surface of the toner patch 105 is formed differs from a position where an image of reflection light from the surface of the image carrier 106 is formed. In other words, a difference between the positions of the peaks of the reflection waveforms (toner reflection waveform 201 and image carrier reflection waveform 202 in FIG. 15) varies according to the thickness of the toner patch 105, and therefore, the thickness of the toner (i.e., the amount of toner adhesion) can be measured from the difference (shown at Pd in FIG. 15) between the peak positions of the reflection waveforms.

The above method can be used effectively for color toner images (yellow, magenta, cyan, etc.) from which reflection light having a sufficient intensity can be obtained. On the other hand, for a black toner image, especially, for a high-density black toner image, a problem is posed that the toner image height cannot be measured with accuracy for the reason that a sufficient amount of reflection light cannot be obtained, as will be described below with reference to FIG. 16.

FIG. 16 is a graph showing a distribution of light amount (reflection waveform 201) obtained by the line sensor 104 in a case where the height of a black toner image is detected by the above described method.

Since most of light irradiated from the light source 101 is absorbed by the black toner, the intensity of a signal obtained by the line sensor 104 becomes extremely small as shown by the reflection waveform 201 in FIG. 16. It is therefore difficult to accurately identify the position of the peak of the reflection waveform 201, and the toner image height cannot be detected with high accuracy.

SUMMARY OF THE INVENTION

The present invention provides a toner image height measurement apparatus and an image forming apparatus having the same, which are capable of accurately measuring heights of respective color toner images with a relatively simple construction and without being affected by toner colors, especially capable of improving the accuracy of height measurement of a black toner image that reflects a small amount of light.

According to a first aspect of this invention, there is provided a toner image height measurement apparatus for measuring a height of a toner image carried on an image carrier, which comprises a light irradiation unit configured to irradiate light onto the toner image carried on the image carrier, a reflection light detection unit configured to detect an intensity of light irradiated by the light irradiation unit and reflected by the toner image or the image carrier, and a calculation unit configured to calculate a height of the toner image based on timing when there occurs a change in the intensity of light detected by the reflection light detection unit.

According to a second aspect of this invention, there is provided an image forming apparatus which comprises an image carrier configured to carry a toner image thereon, a light irradiation unit configured to irradiate light onto the toner image carried on the image carrier, a reflection light detection unit configured to detect an intensity of light irradiated by the light irradiation unit and reflected by the toner image or the image carrier, and a calculation unit configured to calculate a height of the toner image based on timing when there occurs a change in the intensity of light detected by the reflection light detection unit.

With this invention, it is possible to accurately measure heights of toner images carried on the image carrier with a simple construction and without regard to toner colors. In particular, it is possible to improve the accuracy of height measurement of a black toner image that reflects a small amount of light.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

Figure 1:
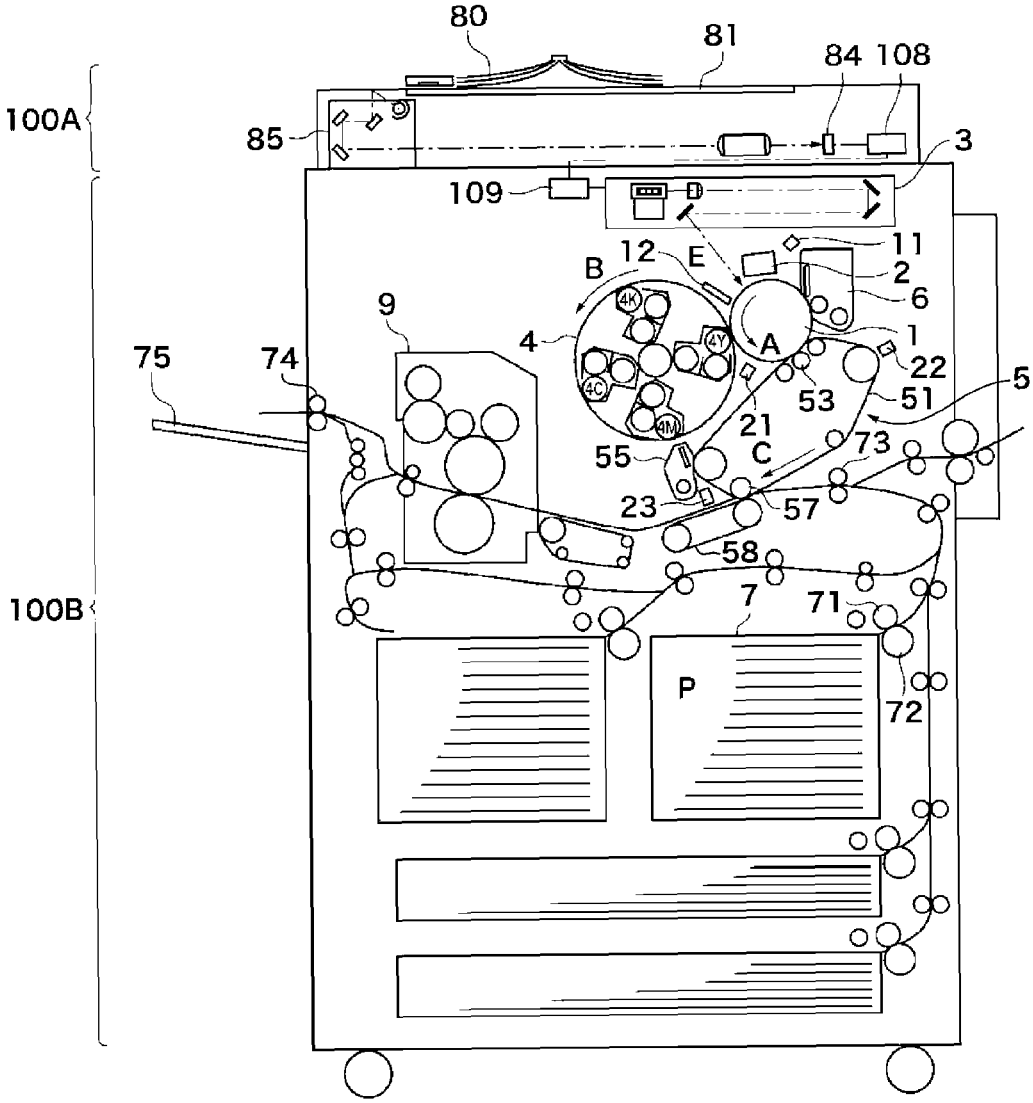
FIG. 1 is a schematic section view showing an electrophotographic image forming apparatus according to a first embodiment of this invention.

FIG. 1 schematically shows in cross section an electrophotographic image forming apparatus according to a first embodiment of this invention.

As shown in FIG. 1, the image forming apparatus of this embodiment includes a printer unit 100B and a reader unit (image scanner) 100A mounted on the printer unit 100B.

The reader unit 100A includes an original table glass 81, a full-color sensor 84 (e.g., a CCD), an image scanning unit 85, and an image processing unit 108. The scanning unit 85 scans an image of an original 80 placed on the table glass 81. The full-color sensor 84 reads an optical image of the original 80 and converts the read image into an image signal. The image processing unit 108 performs predetermined image processing on the image signal obtained by the sensor 84.

The printer unit 100B includes a photosensitive drum 1, a primary charging device 2, an exposure device 3, a developing device 4, a transfer device 5, a cleaning device 6, a fixing unit 9, a static eliminator 11, an intermediate transfer cleaning device 55, and a conveyance belt 58.

The photosensitive drum 1, which is an electrophotographic photosensitive member serving as an electrostatic latent image carrier, is adapted to be rotatably driven in a direction of arrow A. The primary charging device 2 is for uniformly charging a peripheral surface of the photosensitive drum 1. The exposure device 3 is for irradiating exposure light E onto the charged drum 1 according to image information, thereby forming an electrostatic latent image on the photosensitive drum 1. The developing device 4 is for developing the electrostatic latent image on the drum 1 using a developer (toner), thereby forming a visible image (toner image) on the peripheral surface of the drum 1.

The transfer device 5 is for primary-transferring the toner image carried on the drum 1 to the intermediate transfer belt 51 serving as an intermediate transfer member and for secondary-transferring the toner image on the intermediate transfer belt 51 to a recording medium. The cleaning device 6 is for removing residual toner remaining on the surface of the photosensitive drum 1 after the toner image is transferred from the drum surface to the belt 51. The static eliminator 11 is for irradiating light onto the surface of the drum 1 after the residual toner is removed from the drum surface, thereby erasing an electrostatic history.

The intermediate transfer cleaning device 55 is for removing residual toner remaining on the surface of the intermediate transfer belt 51 after the toner image is transferred from the surface of the belt 51 to the recording medium P. The conveyance belt 58 conveys the recording medium P to which the toner image is to be transferred. The fixing unit 9 is for fixing to the recording medium P the toner image formed on the recording medium P conveyed by the belt 58.

Figure 2:
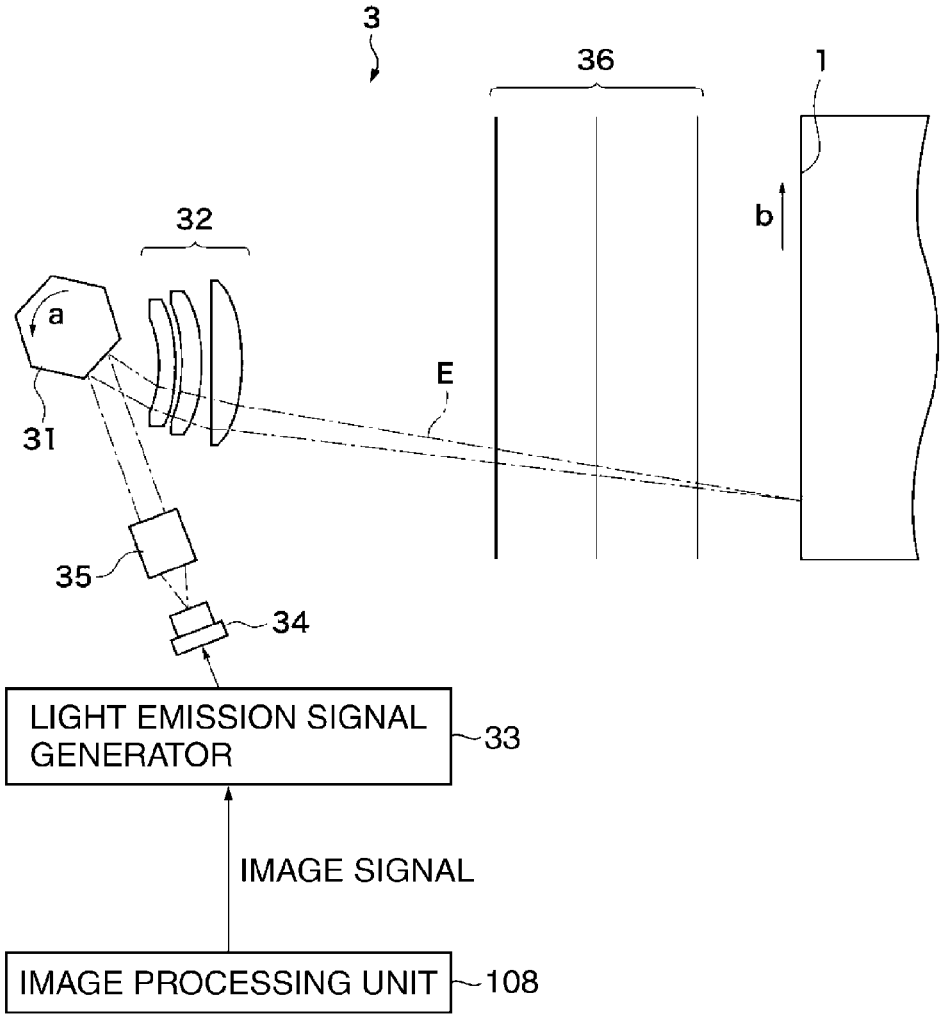
FIG. 2 is a schematic view showing the construction of an exposure device of the image forming apparatus.

In the following, the exposure device 3, the developing device 4, and the transfer device 5 will be described in detail with reference to FIGS. 1 and 2. FIG. 2 schematically shows the construction of the exposure device 3.

As shown in FIG. 2, the exposure device 3 includes a light emission signal generator 33, a solid-state laser 34, a collimater lens system 35, a rotary polygonal mirror (polygon mirror) 31, an f/θ lens group 32, and a reflecting mirror group 36.

The light emission signal generator 33 generates a light emission signal based on an image signal supplied from the image processing unit 108 of the reader unit 100A. The solid-state laser 34 generates laser light according to the light emission signal from the signal generator 33. The collimater lens system 35 regulates an optical path width of the generated laser light. The rotary polygonal mirror 31 reflects the laser light with the regulated optical path width. The laser light reflected by the polygonal mirror 31 is scanned on the photosensitive drum 1 via the f/θ lens group 32 and the reflecting mirror group 36.

The developing device 4 is comprised of, e.g., developing units 4C, 4M, 4Y, 4K and a rotary part provided at its circumference with these developing units. The developing units 4C, 4M, 4Y, 4K store a cyan toner-containing developer, a magenta toner-containing developer, a yellow toner-containing developer, and a black toner-containing developer, respectively. In the developing device 4, each developing unit is moved to a developing position with rotation of the rotary part in a direction of arrow B, and is replenished with new toner corresponding in amount to consumed toner.

The transfer device 5 includes the intermediate transfer belt 51, a primary transfer roller 53, and a secondary transfer roller 57. The intermediate transfer belt 51 is an endless intermediate image carrier adapted to be rotated in a direction of arrow C. The primary transfer roller 53 is used to apply a voltage from a rear surface of the intermediate transfer belt 51 to a primary transfer nip portion between the belt 51 and the photosensitive drum 1. The secondary transfer roller 57 is used to apply a voltage from a rear surface of the recording medium P to a secondary transfer nip portion where the intermediate transfer belt 51 is in contact with the recording medium P.

On the upstream side of the developing device 4, a surface potential sensor 12 for detecting the surface potential of the photosensitive drum 1 is disposed to face an outer circumference of the drum 1. In addition, there are installed in the printer unit 100B one or more toner image height sensors by which the image forming apparatus of this embodiment is characterized. The toner image height sensors are each used to detect a toner image height that varies with changes intoner charge amount, sensitivity of photosensitive member, and transfer efficiency due to repeated developments of electrostatic latent images and developer replacements and that varies with changes in environmental conditions such as temperature and humidity.

Specifically, the printer unit 100B is provided with at least one of toner image height sensors 21, 22, 23. The height sensor 21 is used to detect a height of a toner image developed on the photosensitive drum 1, the height sensor 22 is used to detect a height of a toner image primary-transferred onto the intermediate transfer belt 51, and the height sensor 23 is used to detect a height of a toner image secondary-transferred onto a recording medium P.

By using these sensors, densities or heights of toner images developed on the photosensitive drum 1 or transferred to the intermediate transfer belt 51 and a recording medium P are detected. Based on detection results, toner replenishment and image forming parameters (such as charge potential, image exposure light amount, and developing bias) are feedback-controlled.

In addition, the printer unit 100B includes a printer control unit 109 that controls the overall operation of the printer unit 100B, a sheet feed cassette 7 in which recording media P are stored, sheet feed rollers 71, 72, a registration roller 73, a sheet discharge roller 74, and a sheet discharge tray 75. The sheet feed rollers 71, 72 convey recording media P one by one from the sheet feed cassette 7. The registration roller 73 conveys a recording medium P toward the secondary transfer unit in time with the transfer of toner image. The sheet discharge roller 74 discharges, to the outside of the apparatus, a recording medium P discharged from the fixing unit 9. The recording medium P discharged to the outside of the apparatus is placed on the sheet discharge tray 75.

Next, a description will be given of the overall operation of the image forming apparatus of this embodiment.

First, the operation of the reader unit 100A is described.

In the reader unit 100A, an original 80 is placed on the upper surface of the original table glass 81, with a surface to be copied of the original directed downward, and then held by a copyboard (not shown). When a copy key (not shown) is pressed, the image scanning unit 85 is driven to move along a lower surface of the original table glass 81 from a home position on the left side of FIG. 1 to an end position on the right side of FIG. 1, from which the unit 85 is driven to return to the home position.

During the forward motion of the image scanning unit 85, the downwardly-directed image surface of the original 80 placed on the table glass 81 is illuminated and scanned from left to right by an exposure lamp in the scanning unit 85. Illuminating and scanning light is reflected by the original surface and incident via a short-focus lens array into the full-color sensor 84 to form an image thereon.

The full-color sensor 84 has a light-receiving unit for converting an optical signal into a charge signal and an output unit for converting the charge signal into a voltage signal. The thus obtained voltage signal (analog signal) is output to the image processing unit 108 that performs well known image processing to convert the voltage signal into a digital signal, which is output to the printer control unit 109 of the printer unit 100B. As described above, the reader unit 100A converts image information of the original 80 into a time-series of electric digital pixel signals (image signal).

Next, the operation of the printer unit 100B is described.

As shown in FIG. 2, the exposure device 3 scans and exposes the surface of the photosensitive drum 1 with laser. To this end, the solid-state laser 34 is blinked on and off by the light emission signal generator 33 according to the image signal from the full-color sensor 84, whereby laser light (optical signal) is emitted from the solid-state laser 34. The laser light is made nearly parallel by the collimater lens system 35 and scanned across the photosensitive drum 1 in a direction of arrow b (longitudinal direction), via the f/θ lens group 32 and the reflecting mirror group 36, by the polygonal mirror 31 rotating at high speed in a direction of arrow a, whereby laser spots are formed on the surface of the drum 1.

With the above laser scanning, an exposure distribution for one scanning is formed on the surface of the photosensitive drum 1. By rotating the drum 1 by a predetermined amount at each scanning, it is possible to obtain an exposure distribution on the surface of the drum 1 according to the image signal.

The photosensitive drum 1 is rotatably driven about its center shaft at a predetermined circumferential speed (process speed) of, e.g., 300 mm/sec in the direction of arrow A (counterclockwise) in FIG. 1. The photosensitive drum 1 is uniformly diselectrified by the static eliminator 11 during the drum rotation and then uniformly and negatively corona-charged by the primary charging device 2, so that the outer circumferential surface of the drum 1 is uniformly charged at about −700 V.

As described above, the light on/off emitted from the solid-state laser 34 according to the image signal is scanned across the uniformly charged surface of the photosensitive drum 1 by the polygonal mirror 31 rotating at high speed, whereby an electrostatic latent image is gradually formed on the surface of the drum 1.

The electrostatic latent image formed on the drum 1 is reversely developed and visualized as a first color toner image, by a two-component magnetic brush method, by the corresponding developing unit moved to the developing position facing the drum 1 with rotation of the developing device 4.

With the rotation of the photosensitive drum 1, the toner image formed on the drum 1 reaches the primary transfer unit where the photosensitive drum 1 is in contact with the intermediate transfer belt 51, and the toner image is primary-transferred to the belt 51 by the primary transfer roller 53. The intermediate transfer belt 51 carrying the toner image is rotatably driven in the direction of arrow C toward a position for primary transfer of the next toner image. After completion of the primary transfer, residual toner remaining on the surface of the photosensitive drum 1 is removed by the cleaning device 6, and the surface of the drum 1 is diselectrified by the static eliminator 11 so as to be ready for the next image forming process.

As described above, toner images of respective colors are overlappingly transferred to the intermediate transfer belt 51. On the other hand, the conveyance of the recording medium P fed from the sheet feed cassette 7 is temporarily stopped, with its leading end abutting the registration roller 73, and feed timing is adjusted such that the toner images formed on the belt 51 will be transferred to a predetermined position on the recording medium. The recording medium P is fed from the registration roller 73 at predetermined timing, and reaches the secondary transfer unit where the toner images are secondary-transferred to the recording medium P by the secondary transfer roller 57 applied with a secondary-transfer bias.

The recording medium P onto which the toner images have been secondary-transferred is conveyed by the conveyance belt 58 to the fixing unit 9 where the recording medium P is heated and pressurized, whereby a full-color image is fixed on a surface of the recording medium P. Subsequently, the recording medium P is discharged by the sheet discharge roller 74 to the sheet discharge tray 75.

After completion of the secondary transfer, the intermediate transfer belt 51 is cleaned by the intermediate transfer cleaning device 55 so as to be ready for the next image forming process.

Figure 3:
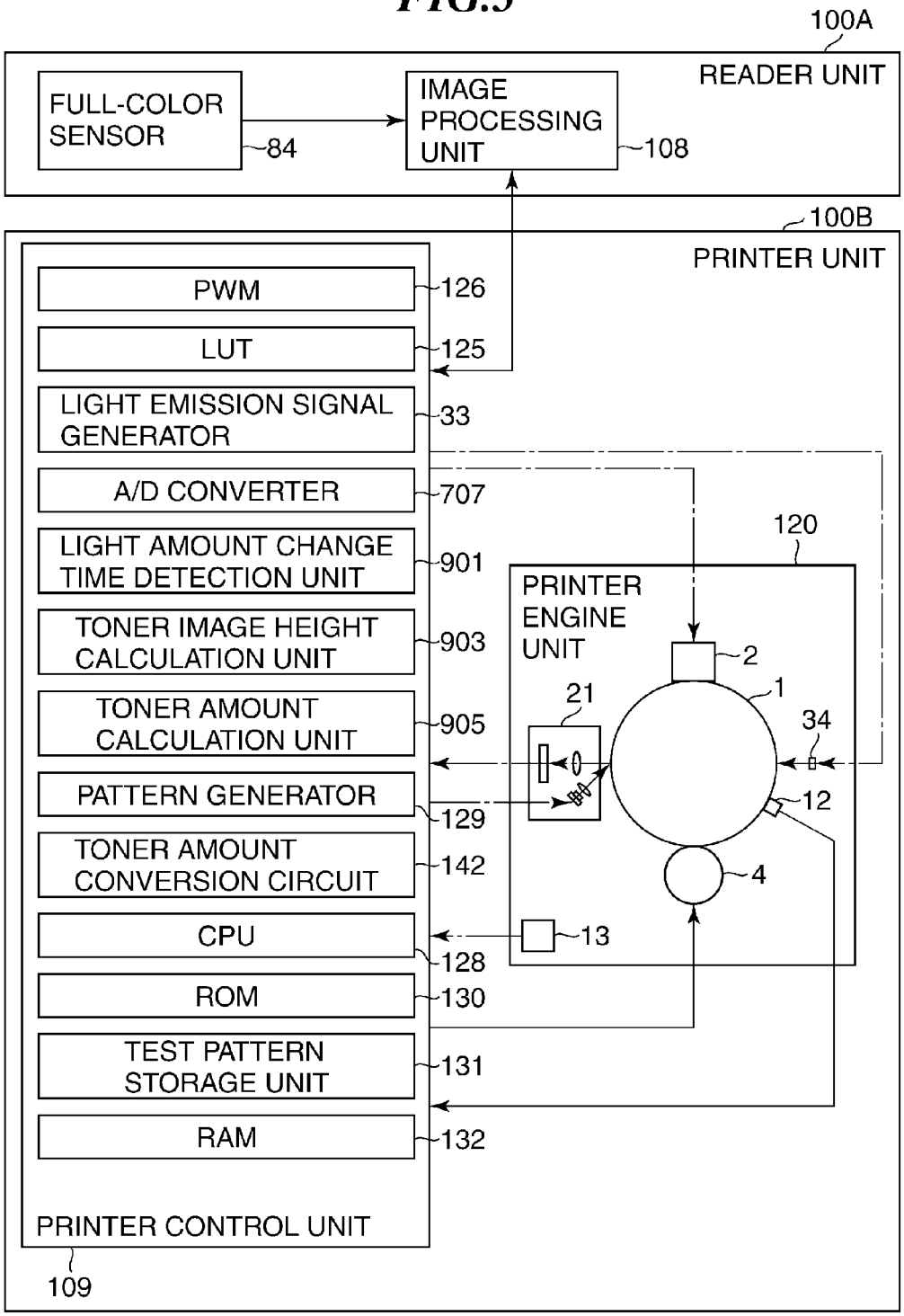
FIG. 3 is a block diagram showing the construction of a printer control unit and a printer engine unit of the image forming apparatus.

FIG. 3 shows in block diagram the construction of the printer control unit 109 and a printer engine unit 120 of the printer unit 100B.

As shown in FIG. 3, the printer control unit 109 includes a LOT (look up table) 125, a PWM (pulse width modulation) circuit 126, a CPU 128, a pattern generator 129, a ROM 130, a test pattern storage unit 131, a RAM 132, and a toner amount conversion circuit 142 as well as the above-described light emission signal generator 33. The printer control unit 109 further includes a signal processing system for processing an output signal from the toner image height sensor 21. The signal processing system includes an A/D converter 707, a light amount change time detection unit 901, a toner image height calculation unit 903, and a toner amount calculation unit 905 (which will be described in detail later with reference to FIG. 12). The printer control unit 109 is able to communicate with the printer engine unit 120 of the printer unit 100B and with the image processing unit 108 of the reader unit 100A.

The CPU 128 controls various parts of the printer control unit 109. The ROM 130 stores a program to be executed by the CPU 128. The RAM 132 provides a work area for use by the CPU 128 and a primary data storage area. The LUT 125 stores information indicating a printer output characteristic. The PWM circuit 126 converts a density signal into a signal corresponding to dot width. The pattern generator 129 generates a predetermined oscillatory frequency. The test pattern storage unit 131 stores a test patch pattern. The toner amount conversion circuit 142 converts an image signal obtained by reading an original into an image density signal.

The printer engine unit 120 includes an environmental sensor 13 in addition to the primary charging device 2, the exposure device 3, the developing device 4, the surface potential sensor 12, and the toner image height sensor 21, which are already described. The printer engine unit 120 is controlled by the printer control unit 109. It should be noted that the printer unit 100B can be provided with at least one of the toner image height sensors 21, 22, and 23. In the following, a description will be give of an example where the toner image height sensor 21 is provided.

A grid bias of the primary charging device 2 and a developing bias of the developing device 4 are controlled by the CPU 128 based on the surface potential of the photosensitive drum 1 detected by the surface potential sensor 12. The environmental sensor 13 measures the water content of air in the image forming apparatus.

In the reader unit 100A, a brightness signal (analog signal) of a read image of an original is obtained by the full-color sensor 84 and converted by the image processing unit 108 into a frame sequential image signal. Based on this image signal and a y characteristic of the printer unit 100B at initial setting, a density characteristic is converted according to the LUT 125 to make an output image density coincident with an original image density.

Next, with reference to FIGS. 4 to 10, a description will be given of the principle of a toner image height measurement method used in this embodiment to measure the height of a toner image formed on the image carrier.

Figure 4:
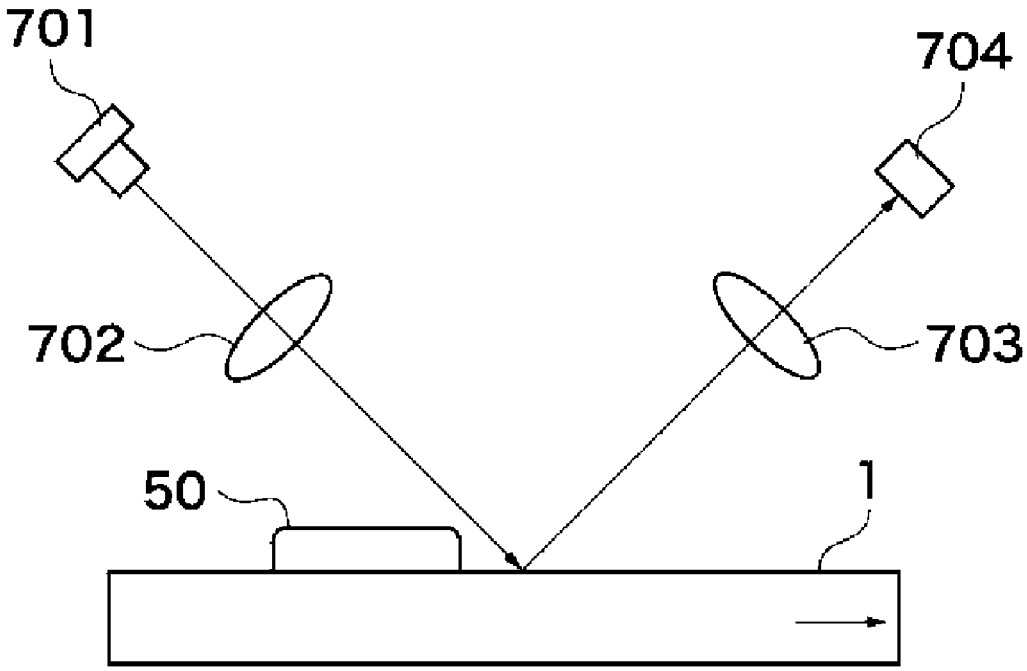
FIG. 4 is a schematic view showing an exemplar construction of a sensor of a toner image height measurement apparatus mounted on the image forming apparatus.
Figure 5A:
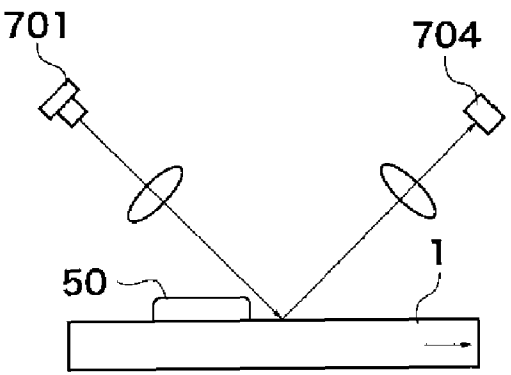
FIGS. 5A, 5B and 5C are schematic views for explaining a measurement principle of the toner image height sensor.
Figure 5B:
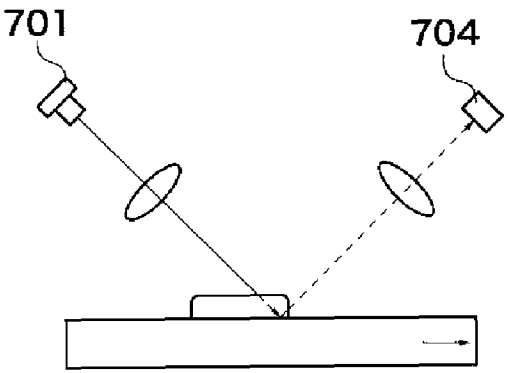
Figure 5C:
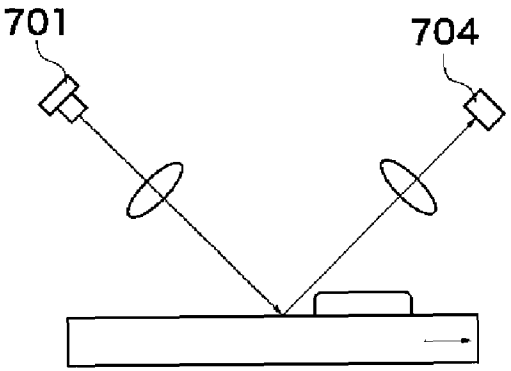

FIG. 4 shows in schematic view an exemplar construction of a sensor of a toner image height measurement apparatus mounted on the image forming apparatus.

As shown in FIG. 4, the toner height measurement apparatus includes a solid-state laser 701, a light collecting lens 702, a light receiving lens 703, and a photodiode 704 (reflection light detection unit).

The solid-state laser 701 emits laser light, which is irradiated onto the image carrier 1 or a toner image 50 formed on the image carrier 1. The photodiode 704 detects light reflected or scattered by the image carrier 1 or the toner image 50. The light collecting lens 702 collects the laser light emitted from the solid-state laser 701. The light receiving lens 703 collects light reflected or scattered by the image carrier 1 or the toner image 50.

In the example of FIG. 4, the photodiode 704 is disposed at a position to detect regular reflection light of the laser light irradiated from the solid-state laser 701 toward the image carrier 1.

With reference to FIGS. 5A to 50 schematically showing the principle of the toner image height measurement of this embodiment, a description is given of how the amount of laser light reflected by the image carrier 1 formed with the toner image 50 changes with movement of the image carrier 1 when the laser light is irradiated from the solid-state laser 701 to the image carrier 1.

The laser light emitted from the solid-state laser 701 is irradiated initially to the image carrier 1 (FIG. 5A), and the light reflected by the image carrier 1 is detected by the photodiode 704. When the image carrier 1 is moved to a position where the laser light is irradiated to the toner image 50 (FIG. 5B), the laser light is reflected or scattered by a surface of the toner image 50, resulting in a reduction in the amount of reflection light detected by the photodiode 704. When the image carrier 1 is further moved to a position where the reflected light is no longer intercepted by the toner image 50 (FIG. 5C), the amount of reflection light detected by the photodiode 704 increases.

Figure 6A:
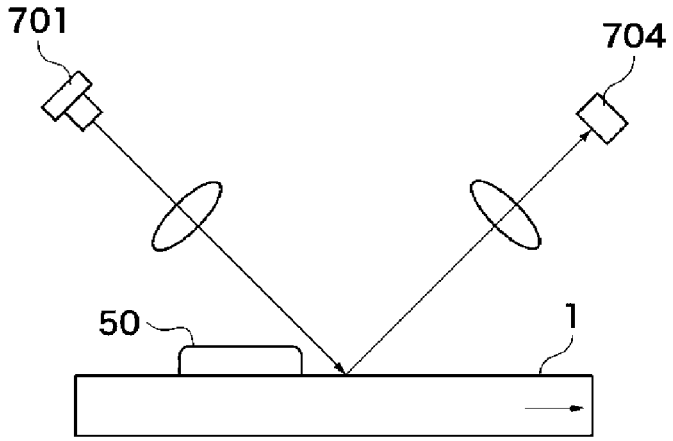
FIGS. 6A and 6B are schematic views for explaining a principle of toner image height detection.
Figure 6B:
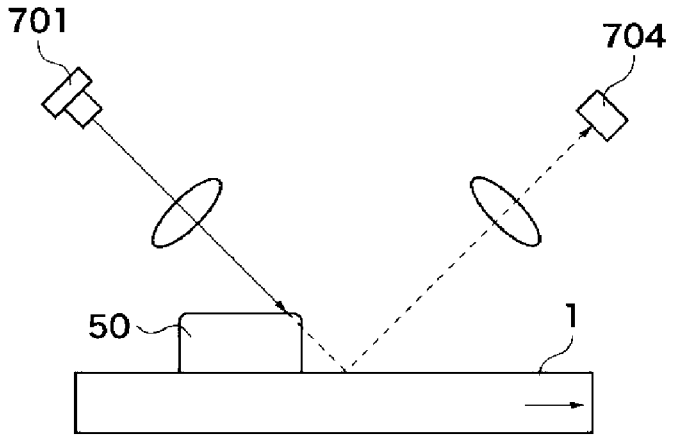

FIGS. 6A and 6B schematically show the principle of toner image height detection in this embodiment.

As shown in FIGS. 6A and 6B, a toner image 50 having a predetermined length in a sub-scanning directional is formed at a predetermined position on the image carrier 1. The amount of reflection light is detected by the photodiode 704, while irradiating laser light from the solid-state laser 701 onto the image carrier 1 that moves in the sub-scanning direction. In that case, timing when the detected amount of reflection light starts to decrease due to the laser light starting to be irradiated onto the toner image 50 varies according to the height of the toner image 50 formed on the image carrier 1. In the example of FIG. 6B where the toner image height is higher than that in FIG. 6A, when the image carrier 1 reaches the same position as that shown in FIG. 6A, the laser light starts to be intercepted by the toner image 50 (the intercepted reflection light is shown by a dotted line in FIG. 6B). As a result, the amount of reflection light starts to decrease. Similarly, timing when the detected amount of reflection light starts to increase due to the toner image 50 being moved to a position where the reflection light is no longer intercepted by the toner image 50 varies according to the height of the toner image 50. In other words, the higher the toner image height, the earlier the timing when the amount of reflection light starts to decrease and the later the timing when the amount of reflection light starts to increase.

As described above, according to the toner height measurement method of this embodiment, the height of the toner image 50 is detected based on timings of (i.e., time periods elapsed from a given reference time until) occurrence of a change in the intensity (amount) of reflection light detected by the photodiode 704.

Figure 7:
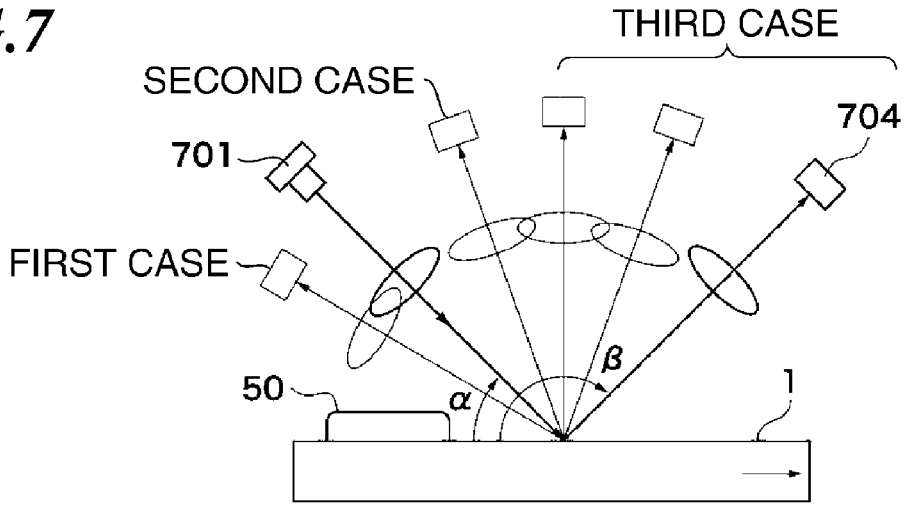
FIG. 7 is a schematic view for explaining a dependency of reflection light amount on the positional relation between a solid-state laser and a photodiode of the sensor in a toner height measurement method according to the first embodiment.

Timings of occurrence of a change in the reflection light amount detected by the photodiode 704 vary also according to a positional relation between the solid-state laser 701 and the photodiode 704. FIG. 7 schematically shows a dependency of reflection light amount on the positional relation between the solid-state laser and the photodiode in the toner height measurement method of this embodiment.

In FIG. 7, symbol $\alpha$ ($\alpha<90$) represents a clockwise angle (degrees) formed between an upper surface of the image carrier 1 and a line connecting the solid-state laser 701 and a laser light irradiation point on the image carrier 1. In other words, the angle $\alpha$ represents a position of the solid-state laser 701. Symbol $\beta$ represents a clockwise angle (degrees) formed between the upper surface of the image carrier 1 and a line connecting the laser light irradiation point and the photodiode 704. In other words, the angle $\beta$ represents a position of the photodiode 704.

The timing when the amount of reflection light detected by the photodiode 704 changes varies according to the positional relation between the solid-state laser 701 and the photodiode 704 (i.e., according to the relation between the angles $\alpha$, $\beta$). The relation between the angles $\alpha$ and $\beta$ is divided into three cases. A first case is one where a relation of $0<3<\alpha$ is satisfied, a second case is one where a relation of $\alpha<\beta<90$ is satisfied, and a third case is one where a relation of $90\leqq\beta<180$ is satisfied.

Figure 8A:
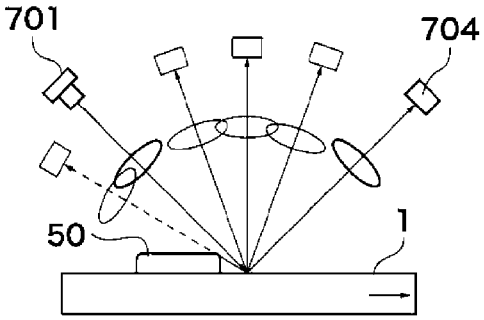
FIGS. 8A and 8B are schematic views for explaining a dependency on the positional relation between the solid-state laser and the photodiode in detecting the toner image height at a front end portion of the toner image.
Figure 8B:
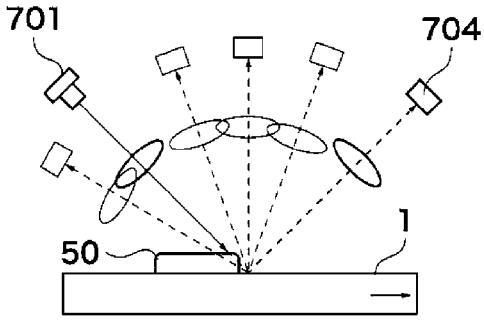

FIGS. 8A and 8B schematically show a dependency on the positional relation between the solid-state laser 701 and the photodiode 704 (i.e., the relation between the angles $\alpha$, $\beta$) in detecting the toner image height at a front end portion of the toner image.

In FIGS. 8A and 8B, it is assumed that the image carrier 1 is moved to the right in the drawings so that the toner image 50 approaches the laser light irradiation position, with the laser light irradiated from the solid-state laser 701 to the image carrier 1.

In the first case ($0<\beta<\alpha$), reflection light toward the photodiode 704 is intercepted by the toner image 50, as shown by a dotted arrow in FIG. 8A, to cause a change in amount of light detected by the photodiode 704 before the laser light emitted from the solid-state laser 701 starts to be irradiated onto the toner image 50. On the other hand, in the second case ($\alpha<\beta<90$) and in the third case ($90\leqq\beta<180$), there occurs a change in amount of reflection light detected by the photodiode 704 in timing when the laser light emitted from the solid-state laser 701 starts to be irradiated onto the toner image 50 (FIG. 8B).

Assuming that symbol $h_1$ denotes the toner image height at the front end portion of the toner image 50 and symbol v denotes the moving speed of the image carrier 1, the toner height $h_1$ for the first case is represented by the following formula (1) as a function of the angle $\beta$, and the toner height $h_1$ for the second and third cases is represented by the following formula (2) as a function of the angle $\alpha$.

$$h_1=v\cdot\Delta t_1\cdot\tan\beta \tag{1}$$

$$h_1=v\cdot\Delta t_1\cdot\tan\alpha \tag{2}$$

In formulae (1) and (2), $\Delta t_1$ denotes a time difference represented by the following formula (3).

$$\Delta t_1=t_a-t_1 \tag{3}$$

In the formula (3), $t_a$ denotes a time period elapsed from a given reference time until the front end of the toner image 50 reaches a toner image writing start position (i.e., the laser light irradiation position in a case where a relation of $h_1=0$ is satisfied), and $t_1$ denotes a time period elapsed from the given reference time until the toner image 50 reaches a position where the laser light is intercepted by the toner image 50.

Since a value of the time period $t_a$ is known, the time difference $\Delta t_1$ can be determined by detecting the time period $t_1$, and therefore, the height of the toner image 50 can be calculated according to formula (1) or (2) selected according to the positional relation between the solid-state laser 701 and the photodiode 704.

Figure 9A:
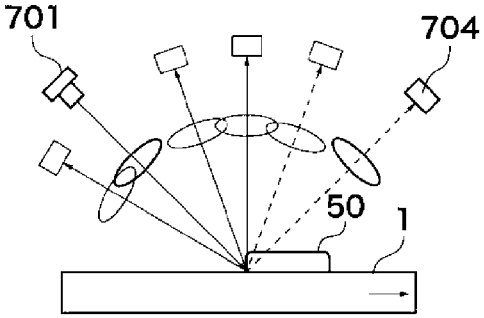
FIGS. 9A and 9B are schematic views for explaining a dependency on the positional relation between the solid-state laser and the photodiode in detecting the toner image height at a rear end portion of the toner image.
Figure 9B:
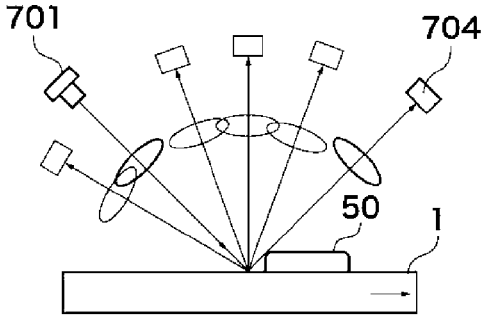

Next, with reference to FIGS. 9A and 9B, a description will be given of a change in light amount detected by the photodiode 704, which is caused by a shift from a state where the laser light is irradiated onto the toner image 50 having a predetermined length in the sub-scanning direction to a state where the laser light is again irradiated onto the image carrier 1. FIGS. 9A and 9B schematically show a dependency on the positional relation between the solid-state laser and the photodiode in detecting the toner image height at a rear end portion of the toner image.

In the first and second cases (FIG. 9A), upon completion of irradiation of the laser light from the solid-state laser 701 onto the toner image 50, the laser light starts to be irradiated onto the image carrier 1. At this timing, a change occurs in the amount of light detected by the photodiode 704. Immediately before occurrence of the change, the laser light is irradiated onto a rear end surface of the toner image 50 for a time period that varies according to the height of the toner image 50. However, such time period cannot easily be detected by means of the construction of this embodiment where only a change in reflection light amount is detected. In the first and second cases, therefore, the time period of laser light irradiation on the rear end surface of the toner image 50 is not used for the detection of the toner image height at the rear end portion of the toner image 50.

In the third case, reflection light from the irradiation point toward the photodiode 704 is intercepted by the toner image 50 as shown by a dotted arrow in FIG. 9A even after the laser light irradiated onto the toner image 50 starts to be irradiated onto the irradiation point on the image carrier 1. If $\Delta t_2$ denotes a time period during which the reflection light is intercepted, the toner image height $h_2$ at the rear end portion of the toner image 50 can be represented by the following formula (4) as a function of the time period $\Delta t_2$, the moving speed v of the image carrier 1, and the angle β representing the position of the photodiode 704.

$$h_2 = v \sim \Delta t_2 \cdot \tan(180-\beta) \quad (4)$$

In the third case, by detecting the time period $\Delta t_2$ that varies according to the toner image height at the rear end portion of the toner image 50, the height of the toner image 50 can be calculated according to the formula (4).

Figure 10:
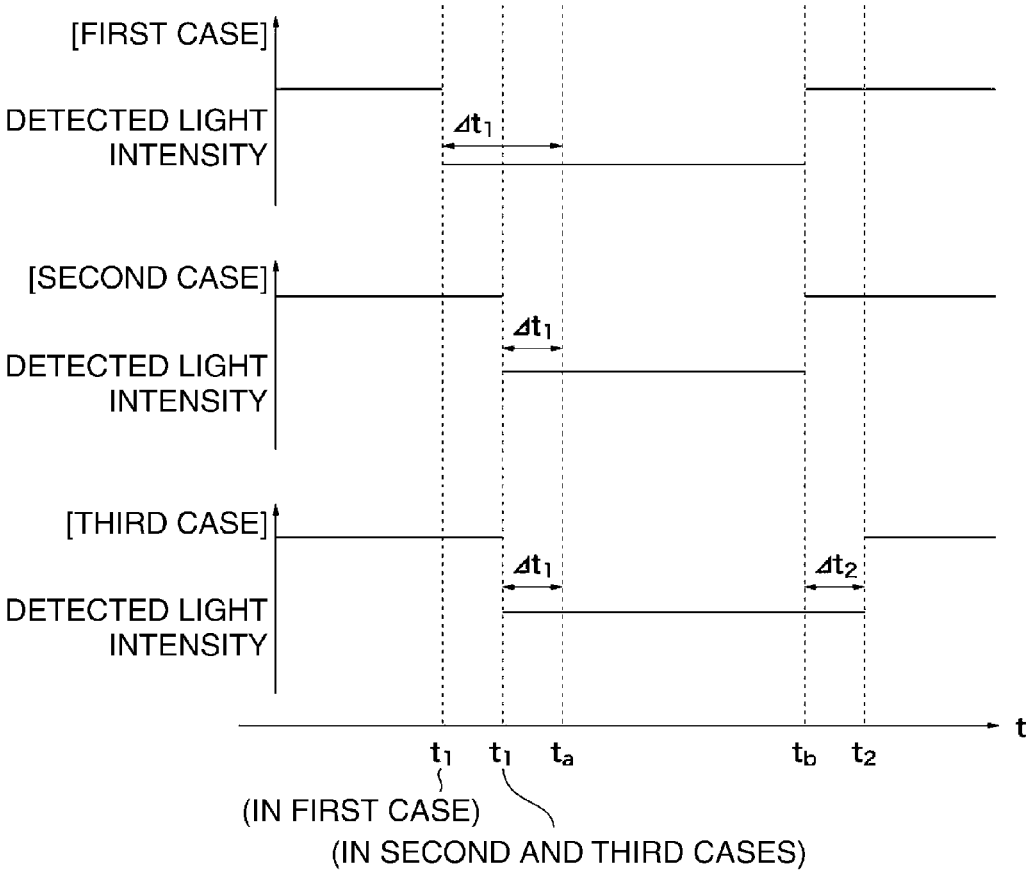
FIG. 10 is a view showing changes in light intensity detected in respective ones of three types of positional relations between the solid-state laser and the photodiode.

FIG. 10 shows changes in light intensity detected in respective ones of the first through third cases (i.e., three types of positional relations between the solid-state laser 701 and the photodiode 704).

As described above, the toner height calculation method and the moving position of toner image 50 where the toner height is to be measured differ among the first, second and third cases. In the image forming apparatus, therefore, the solid-state laser 701 and the photodiode 704 are mounted at appropriate positions selected according to the intended use of the apparatus.

As described above, with the movement of the image carrier 1, the amount of light detected by the photodiode 704 changes in first timing (shown at $t_1$ in FIG. 10) where the laser light irradiated on the image carrier 1 starts to be irradiated onto (or starts to be intercepted by) the toner image 50 and in second timing (shown at $t_2$ in FIG. 10) where the laser light irradiated onto the toner image 50 starts to be irradiated again onto the image carrier 1.

The timings where the amount of light detected by the photodiode 704 changes vary depending on the height of the toner image 50. According to this principle, the toner image height is detected in this embodiment based on a time period until the amount of light changes by a predetermined amount.

Next, with reference to FIGS. 11 and 12, there will be described in detail an example for embodying the toner image height measurement method where the height of the toner image 50 formed on the image carrier 1 of the image forming apparatus is measured based on the above-described measurement principle.

Figure 11:
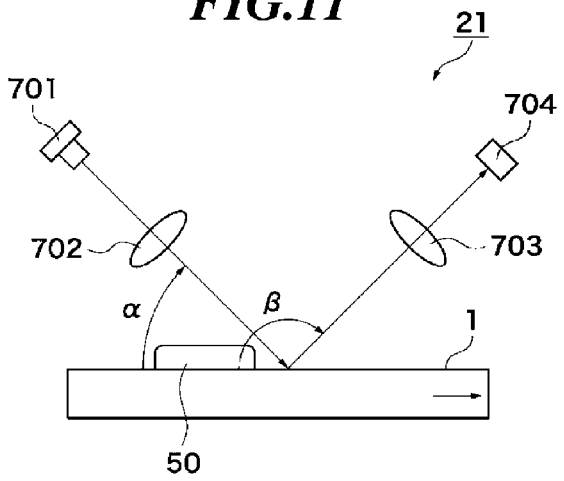
FIG. 11 is a schematic view showing the construction of the toner image height sensor.

FIG. 11 schematically shows the construction of the toner image height sensor 21.

The toner image height sensor 21 includes the solid-state laser 701, the light collecting lens 702, the light receiving lens 703, and the photodiode 704. The angle α representing the position of the laser 701 is 45 degrees, and the angle β representing the position of the photodiode 704 is 45 degrees.

In FIG. 11, laser light (measurement light) emitted from the solid-state laser 701 is irradiated toward the photosensitive drum 1 via the light collecting lens 702, and reflection light (scattered light) from the photosensitive drum 1 or the toner image 50 is formed into an image on the photodiode 704 by the light receiving lens 703. A signal output from the photodiode 704 and representing the amount of reflection light is converted into a digital signal by the A/D converter 707 (see FIG. 12). The signal is processed as described later for calculation of toner amount.

Figure 12:
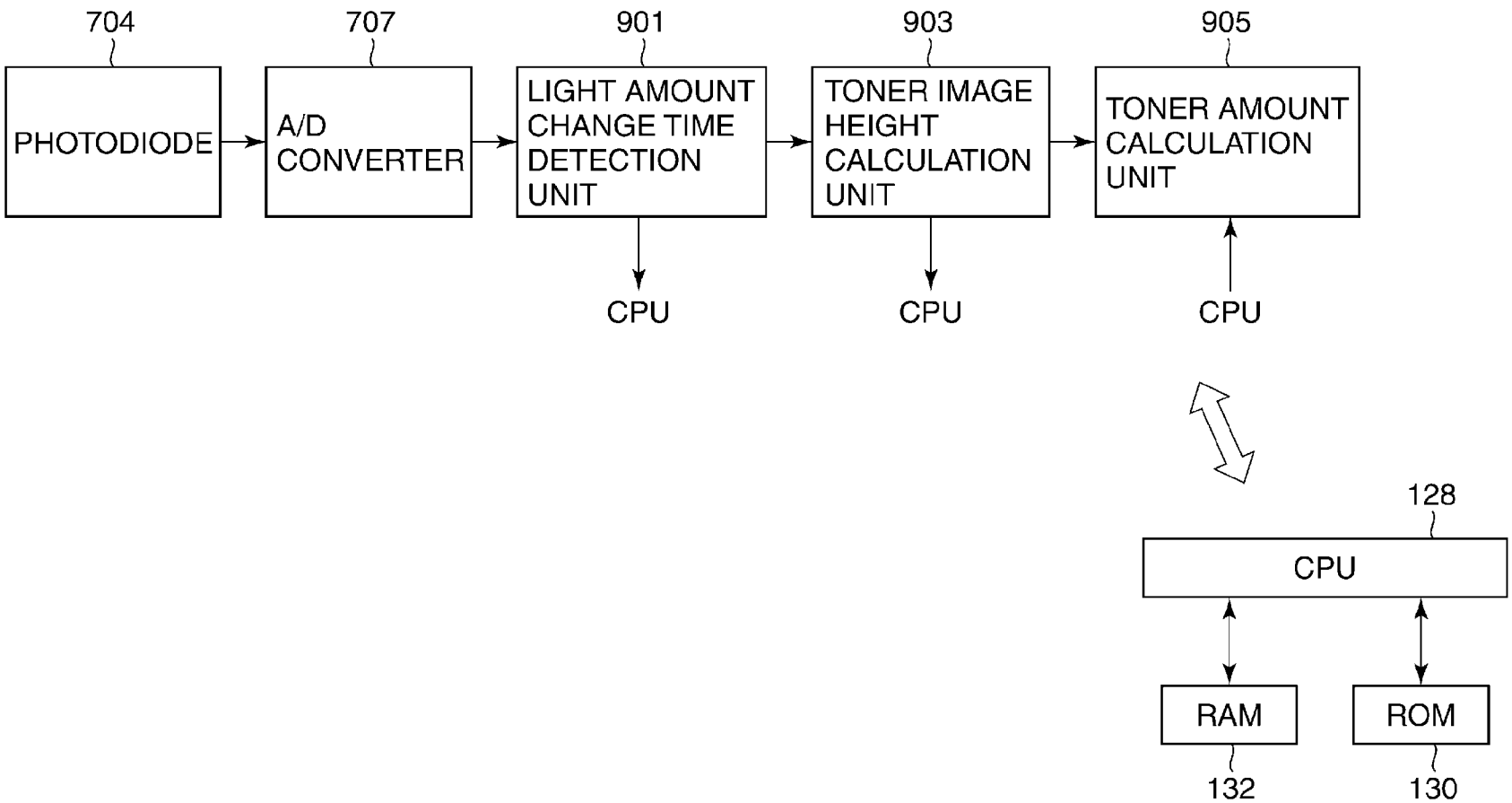
FIG. 12 is a block diagram showing the construction of a signal processing system in which an output signal of the toner image height sensor is processed.

FIG. 12 shows in block diagram the construction of a signal processing system in which the output signal of the toner image height sensor 21 is processed.

As shown in FIG. 12, a signal output from the photodiode 704 and representing the amount of reflection light is converted into a digital signal by the A/D converter 707. The toner image height sensor 21 irradiates measurement light (laser light) to a reference position on the photosensitive drum 1 where the toner image 50 is not formed, and starts measuring the amount of reflection light from the photosensitive drum 1.

With rotary motion of the photosensitive drum 1, the laser light emitted from the solid-state laser 701 starts to be irradiated onto the toner image 50 at a certain time point, and as a result there occurs a decrease in the signal output from the photodiode 704 and representing the reflection light amount. A light amount change time detection unit 901 detects a time period $t_1$ from when the laser light is irradiated onto the reference position to when the detected light amount decreases by a predetermined amount. Information of the time period $t_1$ is stored into the RAM 132 via the CPU 128.

In the ROM 130, there are stored information on the moving speed v of the photosensitive drum 1, information on the angle α representing the position of the solid-state laser 701, and information on a time period $t_a$ required for the laser light irradiation point to move from the reference position to a toner image writing start position. The information of v, α, and $t_a$ stored in the ROM 130 and the information on the time period $t_1$ (first time period) stored in the RAM 132 are sent via the CPU 128 to the toner image height calculation unit 903 in which a toner image height $h_1$ at the front end portion of the toner image 50 is calculated based on the sent information of v, α, $t_a$, and $t_1$ according to the following formulae (5) and (6).

$$\Delta t_1 = t_a - t_1 \quad (5)$$

$$h_1 = v\Delta \cdot t_1 \cdot \tan\alpha \quad (6)$$

With rotary motion of the photosensitive drum 1, the laser light having been irradiated onto the toner image 50 starts to be irradiated again onto the drum 1 at a certain time point. With further rotary motion of the drum 1, the reflection light from the laser light irradiation position on the drum 1 toward the photodiode 704 starts no longer to be intercepted by the toner image 50 at another time point. The light amount change time detection unit 901 in FIG. 12 detects a time period $t_2$ (second time period) from when the laser light emitted from the solid-state laser 701 is irradiated onto the reference position to when the detected light amount having decreased by a predetermined amount is restored. Information of the time period $t_2$ is stored into the RAM 132 via the CPU 128.

In the ROM 130, there is stored information of a time period $t_b$ required for the laser light irradiation point to move from the reference position to a toner image writing end position. The information of v, α, and $t_b$ stored in the ROM 130 and the information of time period t2 stored in the RAM 132 are sent via the CPU 128 to the toner image height calculation unit 903 in which a toner image height $h_2$ at the rear end portion of the toner image 50 is calculated based on the sent information of v, α, $t_b$, and $t_2$ according to the following formulae (7) and (8).

$$\Delta t_2 = t_b - t_2 \quad (7)$$

$$h_2 = v \cdot \Delta t_2 \cdot \tan(180 - \beta) \quad (8)$$

The toner image height calculation unit 903 arithmetically averages the calculated heights $h_1$ and $h_2$ at the front and rear end portions of the toner image 50 according to the following formula (9), thereby accurately determining a height h of the toner image 50.

$$h = (h_1 + h_2)/2 \quad (9)$$

Information of the height h of the toner image 50 determined by the toner image height calculation unit 903 is stored into the RAM 132 via the CPU 128.

In the ROM 130, there are stored a table showing a relation between toner amount and toner image height and a table showing a relation between toner density and toner amount. By referring to these tables, the toner amount calculation unit 905 calculates a density of the toner image formed on the photosensitive drum 1 based on the information of toner image height h stored in the RAM 132.

The construction of the toner image height sensor 21 and the toner image calculation method of the first embodiment are effective for detection of the height of the toner image 50 formed on the image carrier 1, especially, in the case of measurement where a large change occurs in light amount (i.e., in the case of a toner image having a relatively large height).

Second Embodiment

A second embodiment of this invention differs from the first embodiment in the following points, but is the same as the first embodiment in respect of other points, a description of which is omitted.

Figure 13:
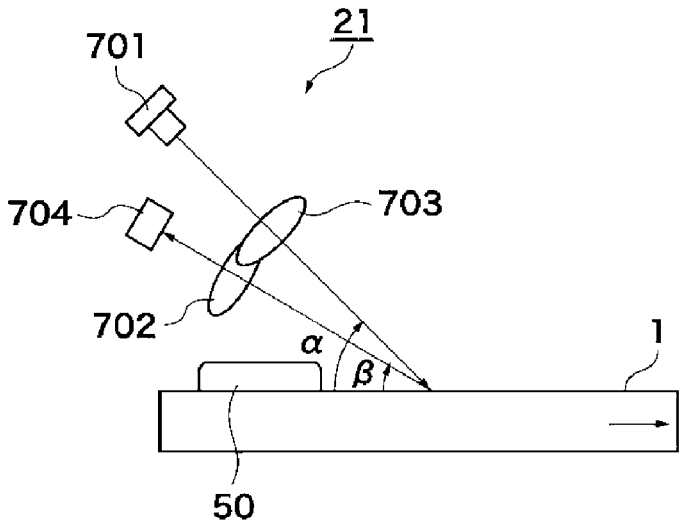
FIG. 13 is a schematic view showing the construction of a toner image height sensor according to a second embodiment of this invention.
Figure 14:
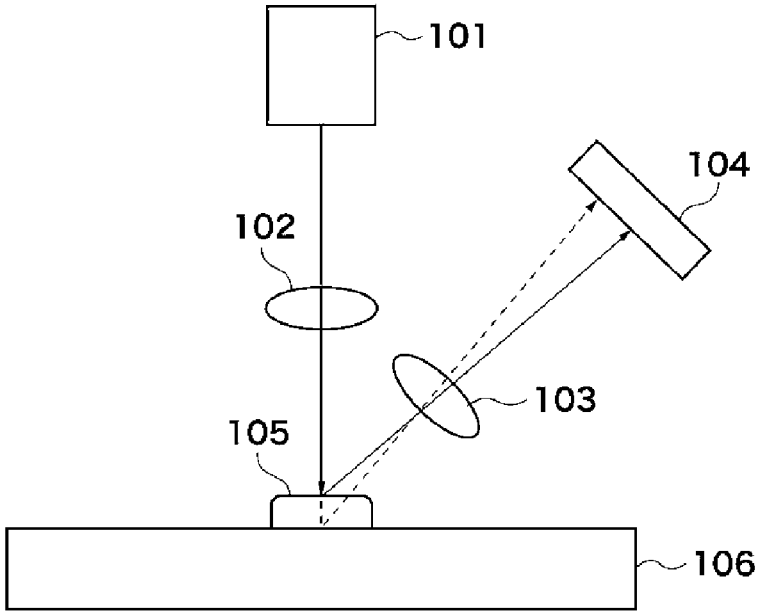
FIG.14 PRIOR ART
FIG. 14 is a schematic view for explaining a conventional toner thickness detection method.
Figure 15:
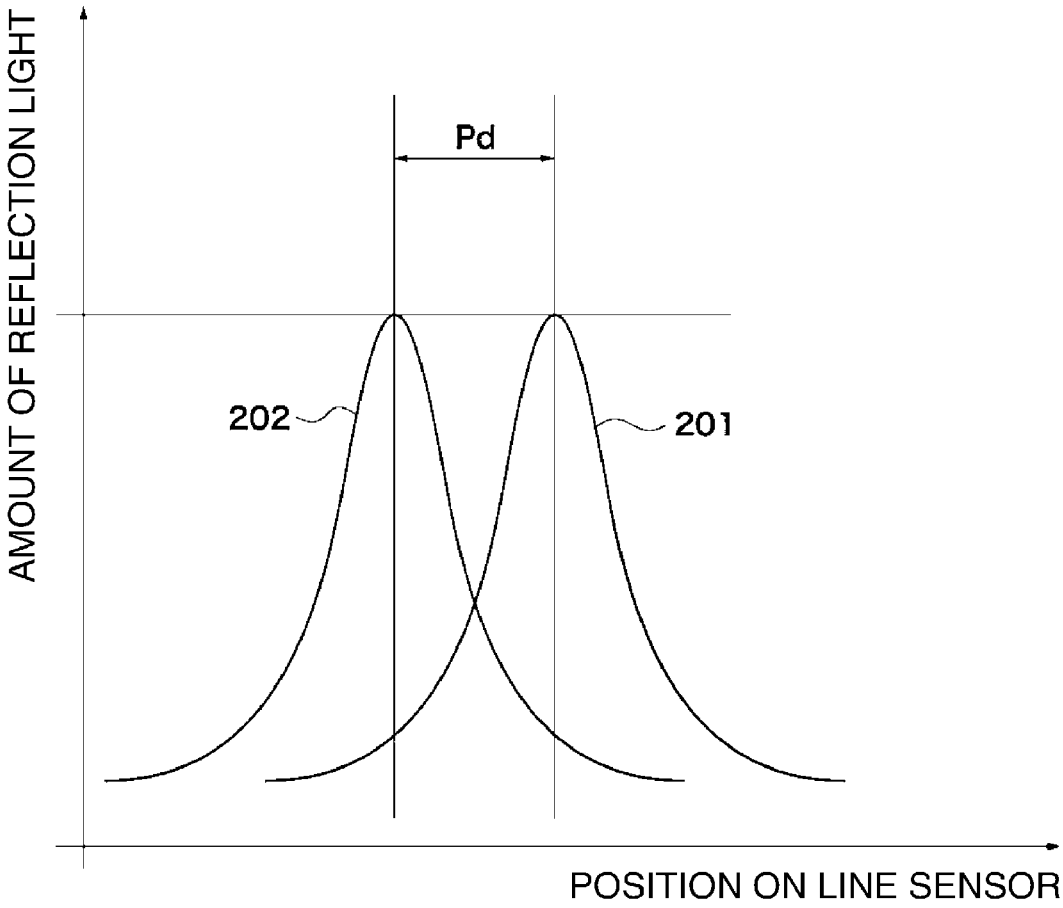
FIG.15 PRIOR ART
FIG. 15 is a view showing reflection waveforms obtained from a line sensor for use in the detection method of FIG. 14.
Figure 16:
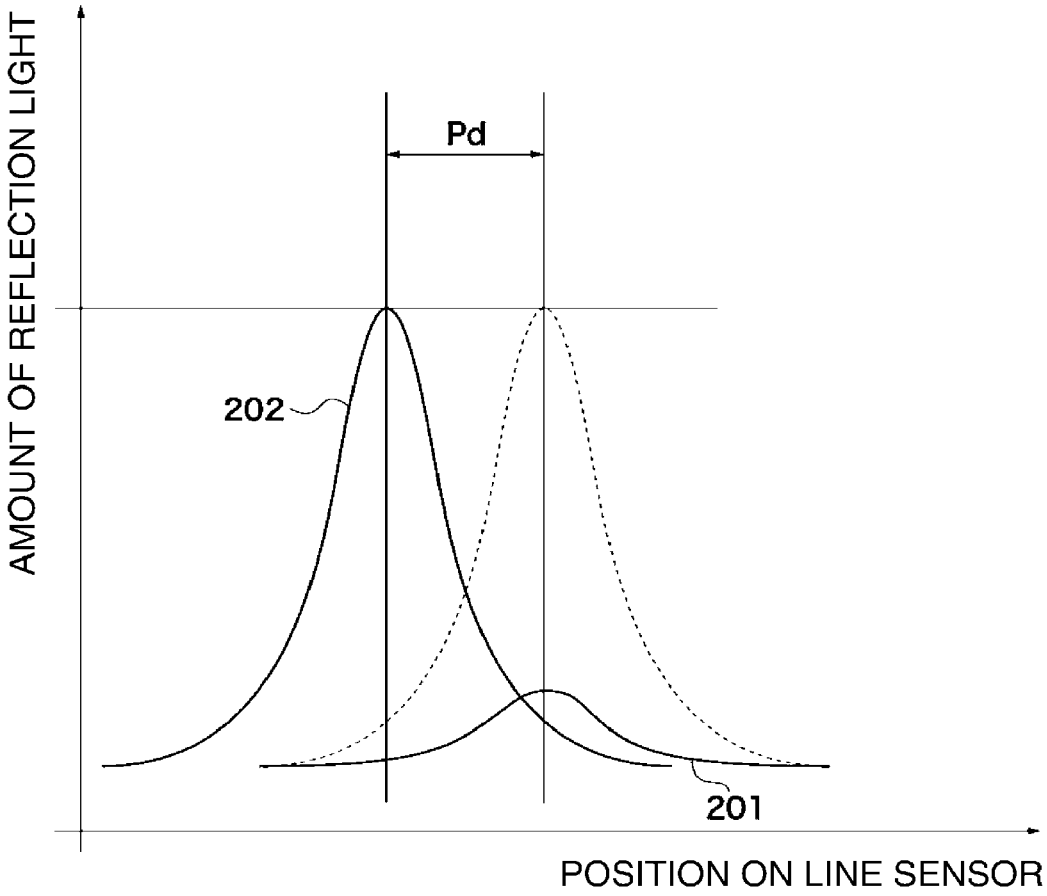
FIG.16 PRIOR ART
FIG. 16 is a graph showing a distribution of light amount in a case where a black toner height is detected by the conventional method.

FIG. 13 schematically shows the construction of the toner image height sensor 21 of the second embodiment.

As shown in FIG. 13, the toner image height sensor 21 includes the solid-state laser 701, the light collecting lens 702, the light receiving lens 703, and the photodiode 704. The angle α representing the position of the laser 701 is 45 degrees and the angle β representing the position of the photodiode 704 is 25 degrees. It should be noted that signal processing is performed in the same manner as in the first embodiment and a description thereof is omitted.

With rotary motion of the photosensitive drum 1, the toner image 50 assumes, at a certain time point, a position where the toner image 50 prevents the laser light from being irradiated onto the surface of the photosensitive drum 1, and as a result there occurs a decrease in the signal output from the photodiode 704 and representing the amount of reflection light.

In the ROM 130, there are stored information on the moving speed v of the photosensitive drum 1, information on the angle α representing the position of the solid-state laser 701, and information on the time period $t_a$ required for the laser light irradiation point to move from the reference position to the toner image writing start position. The information of v, β, and $t_a$ stored in the ROM 130 and the information on the time period $t_1$ stored in the RAM 132 are sent via the CPU 128 to the toner image height calculation unit 903. The time period $t_1$ is a time period from when the laser light (measurement light) emitted from the solid-state laser 701 is irradiated onto the reference position to when the detected light amount decreases by a predetermined amount. A toner image height $h_1$ at the front end portion of the toner image 50 is calculated based on these information according to the following formulae (10) and (11).

$$\Delta t_1 = t_a - t_1 \quad (10)$$

$$h_1 = v \cdot \Delta t_1 \cdot \tan \beta \quad (11)$$

With the arrangement of the toner image height sensor 21 of the second embodiment, the toner image height at the rear end portion of the toner image 50 cannot be measured, as previously described in the description of the measurement principle. Accordingly, the toner image density is determined by using the toner image height $h_1$ at the front end portion of the toner image 50 as the height of the toner image 50. The toner image calculation process is the same as that in the first embodiment and a description thereof is omitted.

The construction of the toner image height sensor 21 and the toner image calculation method of the second embodiment are effective for detection of the height of the toner image 50 formed on the image carrier 1, especially, in the case of measurement sensitive to a height change (e.g., in the case of measurement to be performed with high resolution or in the case of a toner image having a relatively low height).

Other Embodiments

In the first and second embodiments, examples have been described in which the photosensitive drum 1 is used as the image carrier that carries the toner image (measurement object) thereon. Alternatively, the intermediate transfer belt 51 onto which a toner image carried on the photosensitive drum 1 is to be primary-transferred or a recording medium onto which a toner image on the intermediate transfer belt 51 is to be secondary-transferred can be used as the image carrier.

Some component parts of the image forming apparatus (such as the photosensitive member, developing means, and cleaning means) can be integrated into a cartridge that can be detachably mounted to a main body of the image forming apparatus. For example, the photosensitive drum 1 and the cleaning device 6 can be integrated into one apparatus unit that can be mounted to the apparatus main body via a rail or other guide member. In that case, charging means and/or developing means can be provided on the apparatus unit.

In the image forming apparatus of this invention, there are no limitations on ordinary electrophotographic process means (such as exposure mean, developing means, and transfer means). For example, component parts of a cleanerless image forming apparatus can be used therefor.

The image forming apparatus of this invention including the photosensitive member and the charging means not only can be used as an electrophotographic copying machine, but also can be widely used in the electrophotographic field such as laser beam printer, CRT printer, LED printer, liquid crystal printer, or laser platemaker, and can also be configured as a facsimile machine having reception means for receiving image information from a remote terminal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-146473, filed Jun. 19, 2009, which is hereby incorporated by reference herein in its entirety.

What is claimed is:

1. A toner image height measurement apparatus for measuring a height of a toner image carried on an image carrier, comprising:

a light irradiation unit configured to emit an irradiation light to the image carrier;

an output unit having a receiving part which receives, in a case where the irradiation light is reflected by the image carrier, a reflected light from the image carrier, and configured to output a signal based on an intensity of a received light which is received by the receiving part;

a detection unit configured to detect a timing when the irradiation light is intercepted by the toner image based on the signal output from the output unit while the toner image is carried by the image carrier; and a determination unit configured to determine a height of the toner image based on the timing detected by the detection unit.

2. The toner image height measurement apparatus according to claim 1, wherein the detection unit detects a first timing when the intensity of the received light decreases from a first intensity corresponding to the reflected light from the image carrier to a second intensity which is less than the first intensity, and wherein the determination unit determines the height of the toner image based on the first timing detected by the detection unit.

3. The toner image height measurement apparatus according to claim 1, wherein the image carrier is one of a photosensitive member that carries the toner image thereon, an intermediate transfer member onto which the toner image carried on the photosensitive member is to be primary-transferred, and a recording medium onto which the toner image on the inteimediate transfer member is to be secondary-transferred.

4. An image forming apparatus, comprising:

an image carrier configured to carry a toner image thereon;

a light irradiation unit configured to emit an irradiation light to the image carrier;

an output unit having a receiving part which receives, in a case where the irradiation light is reflected by the image carrier, a reflected light from the image carrier, and configured to output a signal based on an intensity of a received light which is received by the receiving part;

a detection unit configured to detect a timing when the irradiation light is intercepted by the toner image based on the signal output from the output unit while the toner image is carried by the image carrier; and a determination unit configured to determine a height of the toner image based on the timing detected by the detection unit.

5. The toner image height measurement apparatus according to claim 1, wherein the detection unit detects a first timing when the intensity of the received light decreases from a first intensity corresponding to the reflected light from the image carrier to a second intensity which is less than the first intensity, and a second timing when the intensity of the received light increases from the second intensity to the first intensity, and wherein the determination unit determines the height of the toner image based on the first timing and the second timing detected by the detection unit.

6. The toner image height measurement apparatus according to claim 5, wherein the determination unit determines the height of the toner image by an average of a first height of the toner image determined based on the first timing and a second height of the toner image determined based on the second timing.

7. The toner image height measurement apparatus according to claim 1, further comprising:

a calculation unit configured to calculate a density of the toner image based on the height of the toner image determined by the determination unit.

8. The toner image height measurement apparatus according to claim 1, wherein an axis of the irradiation light emitted from the light irradiation unit to the image carrier is inclined at a predetermined angle to a direction perpendicular to a surface of the image carrier.

9. A toner image height measurement apparatus for measuring a height of a toner image carried on an image carrier, comprising:

a light irradiation unit configured to emit an irradiation light to the image carrier;

an output unit having a receiving part which receives, in a case where the irradiation light is reflected by the image carrier, a reflected light from the image carrier, and configured to output a signal based on an intensity of a received light which is received by the receiving part;

a detection unit configured to detect a timing when the reflected light from the image carrier is intercepted by the toner image based on the signal output from the output unit while the toner image is carried by the image carrier; and a determination unit configured to determine a height of the toner image based on the timing detected by the detection unit.

10. The toner image height measurement apparatus according to claim 9, wherein the detection unit detects a first timing when the intensity of the received light decreases from a first intensity corresponding to the reflected light from the image carrier to a second intensity which is less than the first intensity, and wherein the determination unit determines the height of the toner image based on the first timing detected by the detection unit.

11. The toner image height measurement apparatus according to claim 9, wherein the detection unit detects a first timing when the intensity of the received light decreases from a first intensity corresponding to the reflected light from the image carrier to a second intensity which is less than the first intensity, and a second timing when the intensity of the received light increases from the second intensity to the first intensity, and wherein the determination unit determines the height of the toner image based on the first timing and the second timing detected by the detection unit.

12. The toner image height measurement apparatus according to claim 11, wherein the determination unit determines the height of the toner image by an average of a first height of the toner image determined based on the first timing and a second height of the toner image determined based on the second timing.

13. The toner image height measurement apparatus according to claim 9, further comprising;

a calculation unit configured to calculate a density of the toner image based on the height of the toner image determined by the determination unit.

14. The toner image height measurement apparatus according to claim 9, wherein an axis of the irradiation light emitted from the light irradiation unit to the image carrier is inclined at a predetermined angle to a direction perpendicular to a surface of the image carrier.

15. An image forming apparatus, comprising:

an image carrier configured to carry a toner image thereon;

a light irradiation unit configured to emit an irradiation light to the image carrier;

an output unit having a receiving part which receives, in a case where the irradiation light is reflected by the image carrier, a reflected light from the image carrier, and configured to output a signal based on an intensity of a received light which is received by the receiving part;

a detection unit configured to detect a timing when the reflected light from the image carrier is intercepted by the toner image based on the signal output from the output unit while the toner image is carried by the image carrier; and a determination unit configured to determine a height of the toner image based on the timing detected by the detection unit.

* * * * *